US011288992B2

(12) United States Patent
Lee et al.

(10) Patent No.: US 11,288,992 B2
(45) Date of Patent: Mar. 29, 2022

(54) DISPLAY DRIVING CIRCUIT FOR ACCELERATING VOLTAGE OUTPUT TO DATA LINE

(71) Applicant: SAMSUNG ELECTRONICS CO., LTD., Suwon-si (KR)

(72) Inventors: Sung-Ho Lee, Hwaseong-si (KR); Jinwoo Kim, Changwon-si (KR); Yongjoo Song, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 16/811,881

(22) Filed: Mar. 6, 2020

(65) Prior Publication Data

US 2021/0043123 A1 Feb. 11, 2021

(30) Foreign Application Priority Data

Aug. 5, 2019 (KR) ..... 10-2019-0094993

(51) Int. Cl.
*G09G 3/20* (2006.01)

(52) U.S. Cl.
CPC ..... *G09G 3/20* (2013.01); *G09G 2310/0275* (2013.01); *G09G 2310/0289* (2013.01);
(Continued)

(58) Field of Classification Search
CPC ... G09G 2320/0276; G09G 2320/0673; G09G 2320/0252; G09G 2320/0223; G09G 2330/028; G09G 3/3696; G09G 2310/0275; G09G 2310/0291; G09G 2310/0289; G09G 2310/0259; G09G 3/3648; G09G 3/3685; G09G 3/3688; G09G 3/3607; G09G 3/2007; G09G 3/2011; G09G 2300/0826; G09G 2310/06; G09G 2310/027; G09G 2310/0251; G09G 2310/0248; G09G 2320/0233; G09G 2320/0247; G09G 2320/0242; G09G 2320/0261
See application file for complete search history.

(56) References Cited

U.S. PATENT DOCUMENTS 6,046,633 A * 4/2000 Shimizu ..... G09G 3/3614 330/51
6,549,196 B1 * 4/2003 Taguchi ..... G09G 3/3688 345/210

(Continued)

FOREIGN PATENT DOCUMENTS

KR 10-2017-0073481 A 6/2017

*Primary Examiner* — Nitin Patel
*Assistant Examiner* — Amen W Bogale
(74) *Attorney, Agent, or Firm* — Sughrue Mion, PLLC

(57) ABSTRACT

A display driving circuit includes a gamma generator configured to output, to nodes, gamma voltages having different voltage levels, and a selector configured to select one of the nodes to which the gamma voltages are output, and output a voltage of the selected one of the nodes. The display driving circuit further includes a voltage regulator configured to selectively input a first current to the selected one of the nodes and output a second current from the selected one of the nodes, based on the voltage of the selected one of the nodes, to adjust a voltage level of the voltage of the selected one of the nodes to a voltage level of a respective one of the gamma voltages that is output to the selected one of the nodes.

20 Claims, 14 Drawing Sheets

(52) U.S. Cl.
CPC ..... *G09G 2310/0291* (2013.01); *G09G 2320/0673* (2013.01)

(56) References Cited

U.S. PATENT DOCUMENTS

| | | | | |
|---|---|---|---|---|
| 6,963,325 | B2 * | 11/2005 | Yano | G09G 3/2011 345/94 |
| 7,295,047 | B2 | 11/2007 | Lee et al. | |
| 7,671,831 | B2 | 3/2010 | Chang et al. | |
| 8,648,637 | B2 | 2/2014 | Kim et al. | |
| 9,543,912 | B2 | 1/2017 | Lee | |
| 2010/0123693 | A1 * | 5/2010 | Utsunomiya | G09G 3/3696 345/205 |
| 2011/0134093 | A1 * | 6/2011 | Chen | G09G 3/3696 345/211 |
| 2017/0032759 | A1 | 2/2017 | Hwang et al. | |
| 2017/0213495 | A1 | 7/2017 | Lee | |
| 2018/0158408 | A1 | 6/2018 | Chae et al. | |
| 2019/0073940 | A1 * | 3/2019 | Morita | H03F 3/45475 |

* cited by examiner

DISPLAY DRIVING CIRCUIT FOR ACCELERATING VOLTAGE OUTPUT TO DATA LINE

CROSS-REFERENCE TO THE RELATED APPLICATION

This application is based on and claims priority under 35 U.S.C. § 119 of Korean Patent Application No. 10-2019-0094993, filed on Aug. 5, 2019, in the Korean Intellectual Property Office, the disclosure of which is incorporated by reference herein in its entirety.

BACKGROUND

The disclosure relates to a display driving circuit, and more particularly, relates to a source driver for accelerating a voltage output to a data line.

Display devices may provide an image to a user. For example, the display devices may include electronic devices such as a smart phone, a tablet PC, a portable multimedia player, a laptop personal computer, a wearable device, etc.

Recently, the demand for high resolution images such as high definition (HD) images and ultra-high definition (UHD) images of the display devices is increasing. As a resolution of a display panel increases from a high definition (HD) to an ultra-high definition (UHD), a line time decreases. Accordingly, the source driver needs to adjust a level of the output voltage to a target level within a shorter time period.

SUMMARY

According to embodiments, a display driving circuit includes a gamma generator configured to output, to nodes, gamma voltages having different voltage levels, and a selector configured to select one of the nodes to which the gamma voltages are output, and output a voltage of the selected one of the nodes. The display driving circuit further includes a voltage regulator configured to selectively input a first current to the selected one of the nodes and output a second current from the selected one of the nodes, based on the voltage of the selected one of the nodes, to adjust a voltage level of the voltage of the selected one of the nodes to a voltage level of a respective one of the gamma voltages that is output to the selected one of the nodes.

According to embodiments, a display driving circuit includes a gamma generator configured to output, to a first node, a first gamma voltage having a first voltage level, and output, to a second node, a second gamma voltage having a second voltage level higher than the first voltage level. The display driving circuit further includes a selector configured to output a second node voltage of the second node to which the second gamma voltage is output, after outputting a first node voltage of the first node to which the first gamma voltage is output, and a voltage regulator configured to, based on a voltage level of the second node voltage being lower than a first reference level, input a first current to the second node to which the second gamma voltage is output. The first reference level is between a level higher than the second voltage level by a threshold level and a level lower than the second voltage level by the threshold level.

According to embodiments, a display driving circuit includes a gamma generator configured to output, to a first node, a first voltage having a first voltage level, and output, to a second node, a second voltage having a second voltage level higher than the first voltage level. The display driving circuit further includes a selector configured to output a first node voltage of the first node to which the first voltage is output, after outputting a second node voltage of the second node to which the second voltage is output, and a voltage regulator configured to, based on a voltage level of the first node voltage being higher than a first reference level, output a first current from the first node to which the first voltage is output. The first reference level is between a level higher than the first voltage level by a threshold level and a level lower than the first voltage level by the threshold level.

DETAILED DESCRIPTION

Embodiments provide a display driver circuit for accelerating a voltage output to a data line.

Hereinafter, the embodiments will be described clearly and in detail such that those skilled in the art may carry out the inventive concept.

Figure 1:
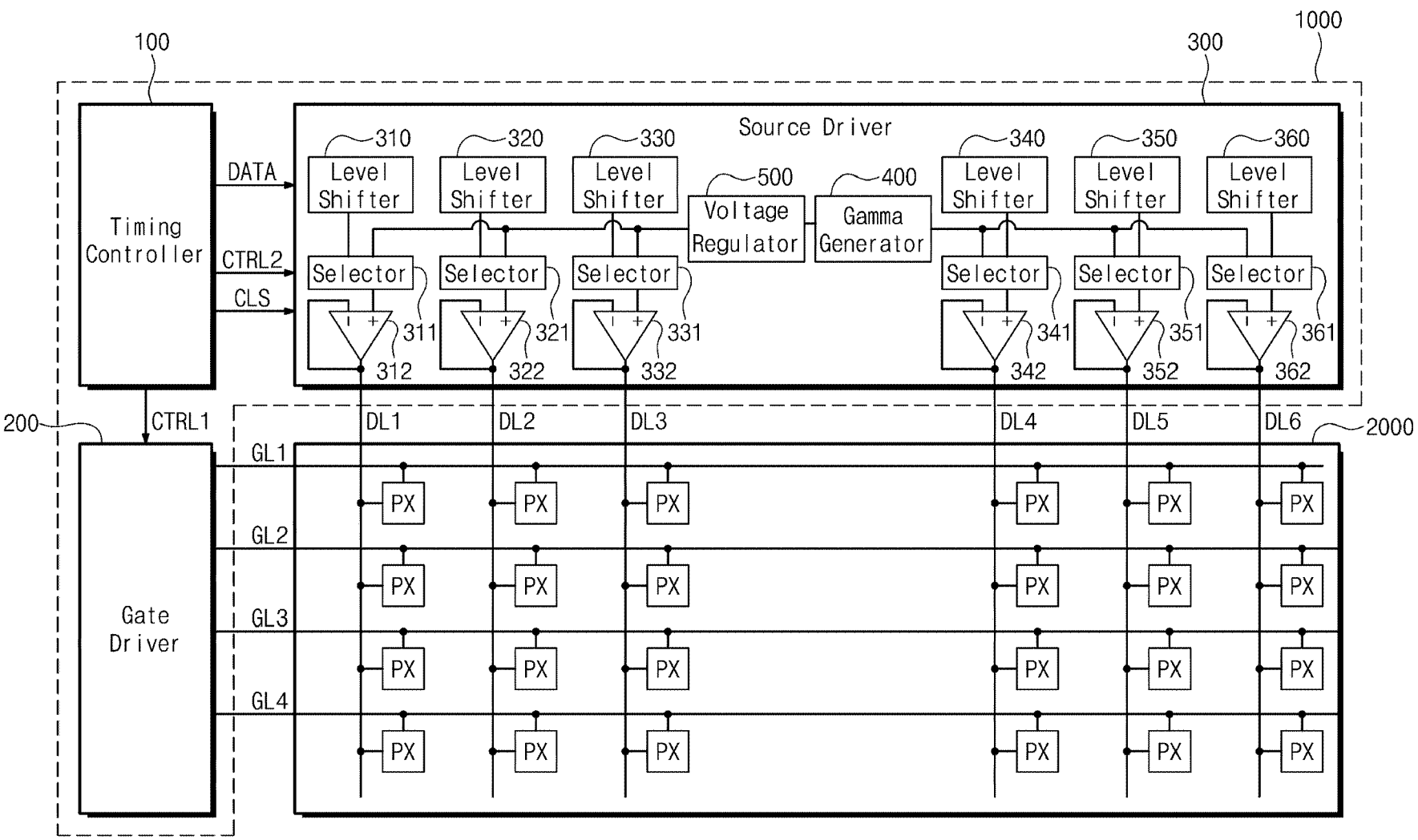
FIG. 1 is a block diagram illustrating a configuration of an electronic device including a display driving circuit according to embodiments.

FIG. 1 is a block diagram illustrating a configuration of an electronic device including a display driving circuit according to embodiments.

An electronic device may include a display driving circuit 1000 and a display panel 2000. The electronic device may be a display device that provides an image display function. For example, the electronic device may include one of electronic devices such as a smart phone, a tablet PC, a portable multimedia player, a laptop personal computer, a camera, an e-book reader, and a wearable device, and the like.

The display driving circuit 1000 may include a timing controller 100, a gate driver 200, and a source driver 300. However, the embodiments are not limited thereto, and the timing controller 100 may be implemented on an integrated circuit chip that is different from the display driving circuit 1000.

The timing controller 100 may receive data and timing signals from an external device (e.g., an application processor). The data received to the timing controller 100 may be data associated with an image displayed on the display panel 2000. The timing signals received to the timing controller 100 may be signals for driving the gate driver 200 and the source driver 300. The timing controller 100 may generate data DATA, control signals CTRL1 and CTRL2, and a selection signal CLS, based on the data and the timing signals.

The gate driver 200 may receive the control signal CTRL1. The gate driver 200 may sequentially output a gate-on signal to each of gate lines GL1 to GL4 in response to the control signal CTRL1.

The source driver 300 may receive the data DATA, the control signal CTRL2, and the selection signal CLS. The source driver 300 may convert the data DATA into image signals in response to the control signal CTRL2 and the selection signal CLS.

The source driver 300 may include level shifters 310 to 360, selectors 311 to 361, output amplifiers 312 to 362, a gamma generator 400, and a voltage regulator 500.

The level shifters 310, 320, 340 to 360, the selectors 311, 321, 341 to 361, and the output amplifiers 312, 322, 342 to 362 may provide substantially the same operations as the operations of the level shifter 330, the selector 331, and the output amplifier 332, respectively. Accordingly, for a better understanding of the embodiments, the operations of the level shifter 330, the selector 331, and the output amplifier 332 will be described in detail below.

The level shifter 330 may receive data DATA. The level shifter 330 may generate a gray level signal indicating a gray level of the data DATA. The gamma generator 400 may generate a plurality of gamma voltages. The plurality of gamma voltages may each have different voltage levels. The selector 331 may receive the gray level signal and the plurality of gamma voltages.

The selector 331 may sequentially output the gamma voltages corresponding to the gray level signal among the plurality of gamma voltages. In detail, the gray level signal may be a digital signal. In this case, the gray level signal may be composed of bits. For example, the gray level signal may be a signal in which a first bit set and a second bit set are sequentially arranged. The first bit set and the second bit set may correspond to a first gamma voltage having a first voltage level and a second gamma voltage having a second voltage level, respectively. When the gray level signal is received, the selector 331 may output the first gamma voltage in response to the first bit set, and then output the second gamma voltage in response to the second bit set.

The selector 331 may sequentially output the gamma voltages (e.g., the first gamma voltage and the second gamma voltage) to the output amplifier 332. The output amplifier 332 may output an image signal to a data line DL3 in response to the received gamma voltages.

As the number of data lines DL1 to DL6 and the gate lines GL1 to GL4 that are included in the display panel 2000 increases, the output amplifier 332 needs to output the image signal at a high speed. In order for the output amplifier 332 to output the image signal at the high speed, the selector 331 needs to output the gamma voltages corresponding to the gray level signal at the high speed. The selector 331 according to embodiments may output the gamma voltages corresponding to the gray level signal at the high speed, based on the voltage regulator 500. In detail, the voltage regulator 500 may quickly pull down or pull up a level of the voltage input to the selector 331 to the target level.

In detail, the voltage regulator 500 may operate to adjust a level of the output voltage of the selector 331 to the second voltage level at the high speed after the first gamma voltage having the first voltage level is output from the selector 331. Therefore, a line time of the display driving circuit 1000 may be reduced. The line time may be associated with a time for inputting an input signal to pixels that are positioned in one of the data lines DL1 to DL6. Although only one voltage regulator 500 is illustrated in FIG. 1, the embodiments are not limited thereto. The source driver 300 may include one or more voltage regulators 500, and the voltage regulator 500 may be located between some of the selectors 311 to 361. The configurations and operations of the voltage regulator 500 will be described in detail with reference to FIGS. 2 to 13.

The display panel 2000 may include the gate lines GL1 to GL4 arranged in a horizontal direction (or a row direction), the data lines DL1 to DL6 arranged in a vertical direction (or a column direction), and pixels (PXs). The pixels PXs may be positioned in an area where the gate lines GL1 to GL4 and the data lines DL1 to DL6 cross each other. In FIG. 1, six data lines DL1 to DL6 and four gate lines GL1 to GL4 are illustrated, but the embodiments are not limited thereto. The electronic device may include a plurality of data lines and a plurality of gate lines.

The display panel 2000 may receive a gate-on signal and the image signal. The pixels PXs may receive image signals, respectively. Among the pixels PX, pixels positioned in the gate line through which the gate-on signal is received may output optical signals corresponding to the image signals. The display panel 2000 may display the image to the user, based on the optical signals that are output from the pixels.

Figure 2:
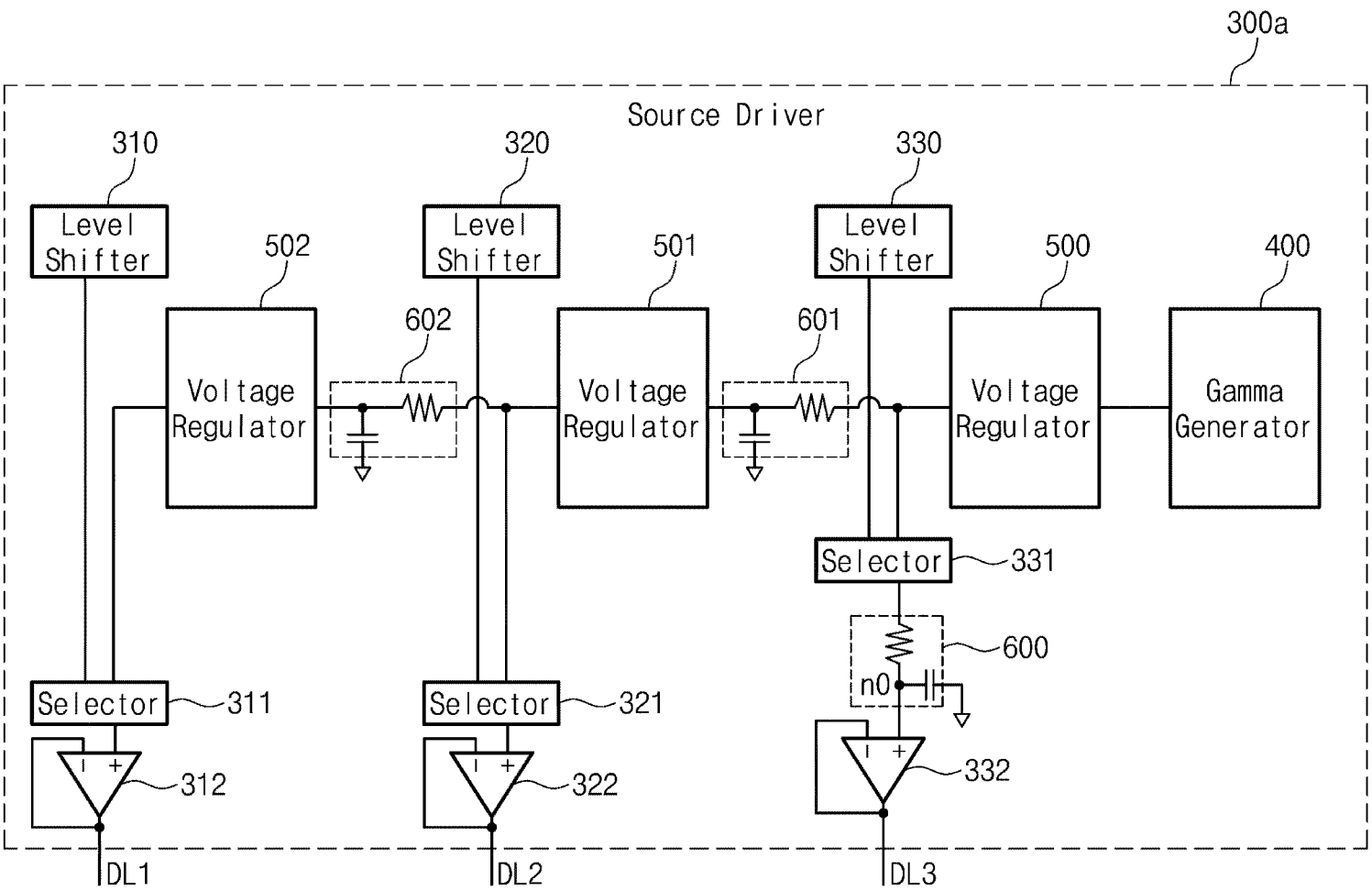
FIG. 2 is a block diagram illustrating a configuration of a source driver according to embodiments.

FIG. 2 is a block diagram illustrating a of a source driver according to embodiments. Components of a source driver 300*a* may provide operations similar to those of the source driver 300 of FIG. 1.

The source driver 300*a* may include level shifters 310 to 330, selectors 311 to 331, output amplifiers 312 to 332, the gamma generator 400, voltage regulators 500 to 502, and parasitic circuits 600 to 602. In FIG. 2, only components positioned on the left side of the gamma generator 400 are illustrated, but the embodiments are not limited thereto. Level shifters, selectors, output amplifiers, voltage regulators, and parasitic circuits may also be located on the right side of the gamma generator 400, like that illustrated in FIG. 1.

The source driver 300*a* may include three voltage regulators 500 to 502. However, the embodiments are not limited thereto, and the source driver 300*a* may include one or more voltage regulators to output the image signal at the high speed. In addition, the source driver 300*a* may selectively include some of the three voltage regulators 500 to 502.

As in the description with reference to FIG. 1, operations of the level shifter 330, the selector 331, and the output amplifier 332 will be intensively described with reference to FIG. 2. The level shifters 310 and 320, the selectors 311 and 321, and the output amplifiers 312 and 322 may provide substantially the same operations as those of the level shifter 330, the selector 331, and the output amplifier 332, respectively.

In the following descriptions, it is assumed that the selector 331 outputs the first gamma voltage having the first voltage level for a time and then outputs the second gamma voltage having the second voltage level for a time. The selector 331 may output the first gamma voltage and then output the second gamma voltage in response to the gray level signal in which the first bit set and the second bit set are sequentially arranged. In the following descriptions, for a better understanding of the embodiments, the level shifter 330 is represented as outputting the second bit set after a time after outputting the first bit set. The selector 331 starts an operation for outputting the second gamma voltage when the second bit set is received. For a better understanding of the embodiments, the voltage that the selector 331 intends to input to the output amplifier 332 is represented as the target voltage. In addition, the level of the target voltage is represented as the target level.

The source driver 300*a* may include the parasitic circuits 600 to 602. Due to the parasitic circuits 600 to 602, a delay in which the gamma voltages generated by the gamma generator 400 is transferred to the output amplifiers 312 to 332 may be generated. The parasitic circuits 600 to 602 may include a parasitic resistor and a parasitic capacitor, respectively. In the following descriptions, for the convenience of description, the voltage drop due to the resistor of the parasitic circuit 600 is ignored.

While the selector 331 outputs the first gamma voltage, the voltage level of a node n0 may be the first voltage level. In the following descriptions, a level of the voltage of the node n0 is represented as a voltage level of the node n0. While the selector 331 outputs the first gamma voltage, charges corresponding to the first gamma voltage may be charged in the capacitor of the parasitic circuit 600. Therefore, after the second bit set is received to the selector 331, there may be the delay in adjusting the voltage level of the node n0 from the first voltage level to the second voltage level. Also, the charges may be charged in the capacitors of the parasitic circuits 601 and 602. The charges that are charged in the capacitors of the parasitic circuits 601 and 602 may be associated with the gamma voltages input to the output amplifiers 312 and 322. The delay may occur until when the voltage of the node n0 is adjusted by the charges charged in the capacitors of the parasitic circuits 601, 602, and 600. The voltage regulator 500 may shorten a delay time occurring when the voltage level of the node n0 is adjusted from the first voltage level to the second voltage level. Operations of the voltage regulator 500 to shorten the delay time will be described in detail with reference to FIG. 3.

The parasitic circuits may also exist between the selectors 311 and 321 and the output amplifiers 312 and 322. Therefore, the delay may occur until the target voltages are input to the output amplifiers 312 and 322. The voltage regulators 500 and 501 may shorten the delay time for inputting the target voltage to the output amplifier 322. In addition, the voltage regulators 500, 501, and 502 may shorten the delay time for inputting the target voltage to the output amplifier 312.

The number and position of voltage regulators included in the source driver 300*a* may be determined by comprehensively considering the size, price, effect, and etc. of the voltage regulators. To quickly output the image signals to the data lines DL1 to DL3, an area of the source driver 300*a* may be reduced by using the voltage regulators 500 to 502 rather than using a plurality of gamma generators. In addition, by reducing the time it takes for the gamma voltages output from the gamma generator 400 to be transferred to the output amplifier 312, using the voltage regulators 500 to 502, the time difference between a time when the image signal is output to the data line DL1 and a time when the image signal is output to the data line DL2 may decrease. That is, the source driver 300*a* according to embodiments may uniformly adjust the times for outputting voltages to the data lines.

Figure 3:
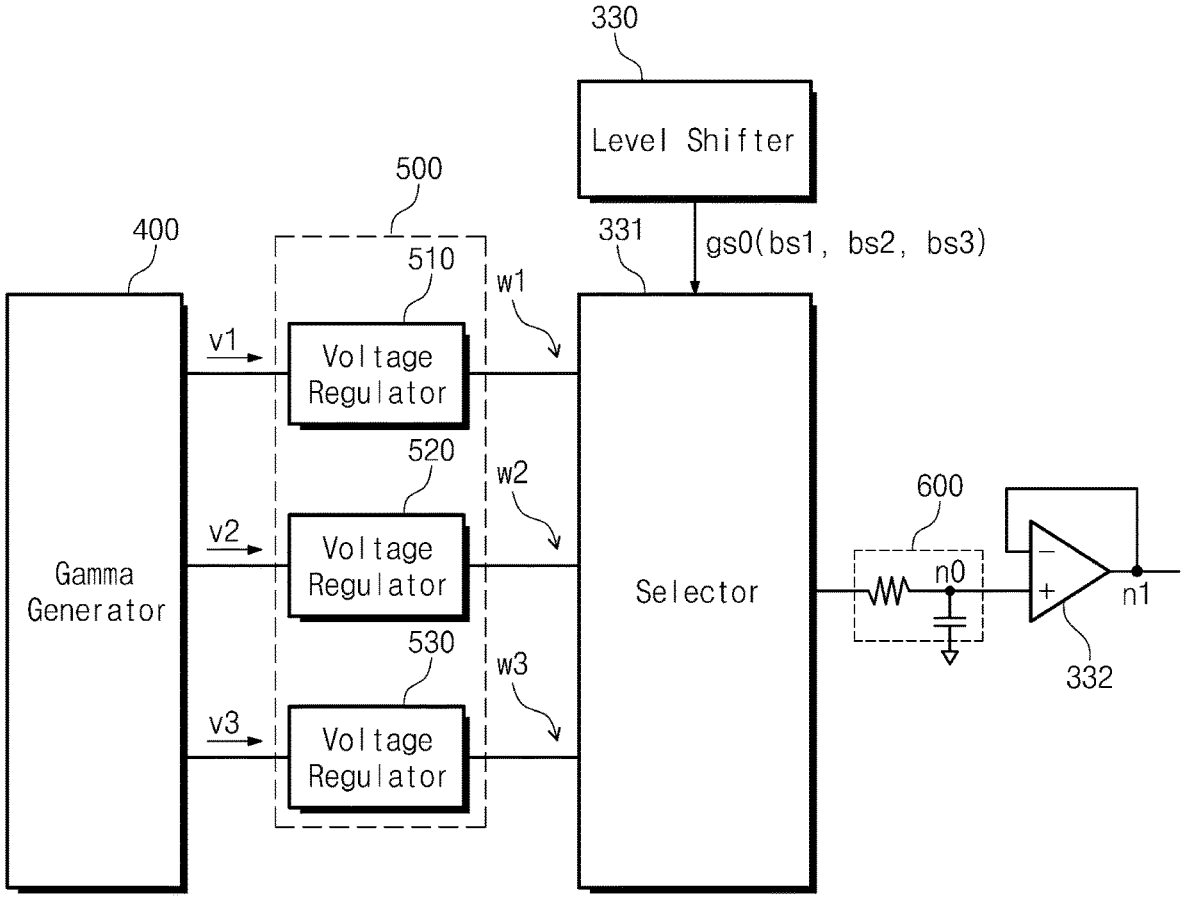
FIG. 3 is a block diagram illustrating a voltage regulator according to embodiments.

FIG. 3 is a block diagram illustrating a voltage regulator according to embodiments.

Referring to FIG. 3, the voltage regulator 500 that is positioned between the gamma generator 400 and the selector 331 is described in detail. Thus, for a better understanding of the embodiments, only some of the components of the source driver 300*a* shown in FIG. 2 are illustrated in FIG. 3.

The gamma generator 400 may output a plurality of gamma voltages v1 to v3 to the selector 331. Levels of the gamma voltages v1 to v3 may be a first voltage level, a second voltage level, and a third voltage level, respectively. The first voltage level may be lower than the second voltage level, and the second voltage level may be lower than the third voltage level. In FIG. 3, only three gamma voltages v1 to v3 are presented, but the embodiments are not limited thereto.

The selector 331 may be connected to the gamma generator 400 through a plurality of connection lines w1 to w3. The plurality of connection lines w1 to w3 may be electrical wires for transmitting electrical signals. The gamma voltages v1 to v3 output from the gamma generator 400 may be input to the selector 331 through the plurality of connection lines w1 to w3, respectively. The voltage regulator 500 may be positioned on the plurality of connection lines w1 to w3. The voltage regulator 500 may include voltage regulators 510 to 530. In detail, the voltage regulators 510 to 530 may be positioned on the plurality of connection lines w1 to w3, respectively.

The voltage regulators 510 to 530 are positioned on the plurality of connection lines w1 to w3 in FIG. 3, but the embodiments are not limited thereto. The voltage regulator 500 may selectively include one or more voltage regulators of the voltage regulators 510 to 530.

Each of the voltage regulators 510 to 530 may provide similar operations as the voltage regulator 500. The voltage regulators 510 to 530 may reduce the delay time that occurs until when the voltage level of the node n0 is adjusted to the target voltage level.

The level shifter 330 may output a gray level signal gs0. The gray level signal gs0 may be a signal in which a first bit set bs1, a second bit set bs2, and a third bit set bs3 are sequentially arranged. The bit sets bs1 to bs3 may correspond to the gamma voltages v1 to v3, respectively. When the bit set is input, the selector 331 may start an operation for outputting the gamma voltage corresponding to the bit set.

The selector 331 may include a multiplexer for selectively outputting one gamma voltage among the gamma voltages v1 to v3 input from the plurality of connection lines w1 to w3. However, the embodiments are not limited thereto, and the selector 331 may be implemented by a combination of one or more decoders and one or more multiplexers. For example, when the second bit set bs2 is input after the first bit set bs1 is input to the selector 331, the selector 331 may start an operation for outputting the second gamma voltage v2. While the first gamma voltage is output from the selector 331, the voltage level of the node n0 may be the first voltage level. The voltage regulator 520 may reduce the delay time that occurs until when the voltage level of the node n0 is adjusted from the first voltage level to the second voltage level. That is, the voltage regulators 510 to 530 may reduce delay times that occur until when the voltage level of the node n0 is adjusted to the first voltage level, the second voltage level, and the third voltage level, respectively.

Figure 4:
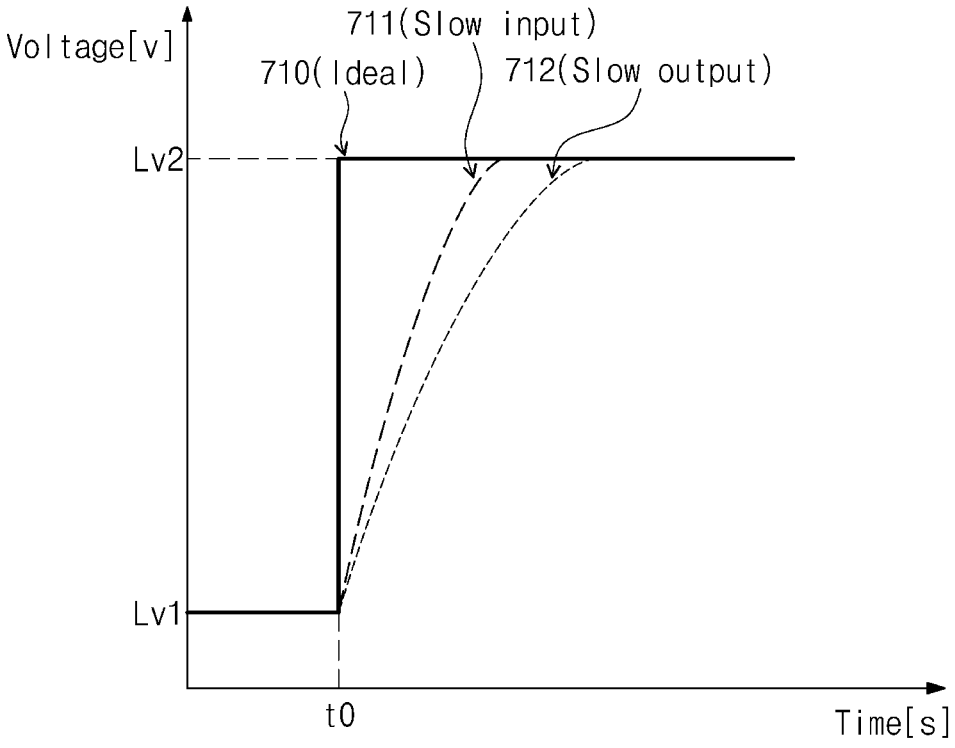
FIG. 4 is a graph describing an operation of a source driver.

FIG. 4 is a graph describing an operation of a source driver. The x-axis of the graph may mean time[s], and the y-axis of the graph mean voltage[v].

Before a time t0, the selector 331 of FIG. 3 may output the first gamma voltage v1. At the time t0, the selector 331 may receive the second bit set bs2 of FIG. 3. Accordingly, the selector 331 may start an operation for outputting the second gamma voltage v2 at the time to.

A graph 710 represents the voltage level of a node n1 of FIG. 3 in an ideal case. In the ideal case, the output amplifier 332 may output the second gamma voltage v2 as soon as the second bit set bs2 is input to the selector 331.

When the voltage regulator 520 of FIG. 3 does not operate, the voltage level of the node n0 of FIG. 3 is adjusted more slowly to the second voltage level. A graph 711 represents the voltage level of the node n0 when the voltage level of the node n0 is adjusted more slowly to the second voltage level. A graph 712 represents the voltage level of the node n1 of FIG. 3. Because the voltage level of the node n0 is adjusted more slowly to the second voltage level, the voltage level of the node n1 is also adjusted more slowly to the second voltage level.

Figure 5:
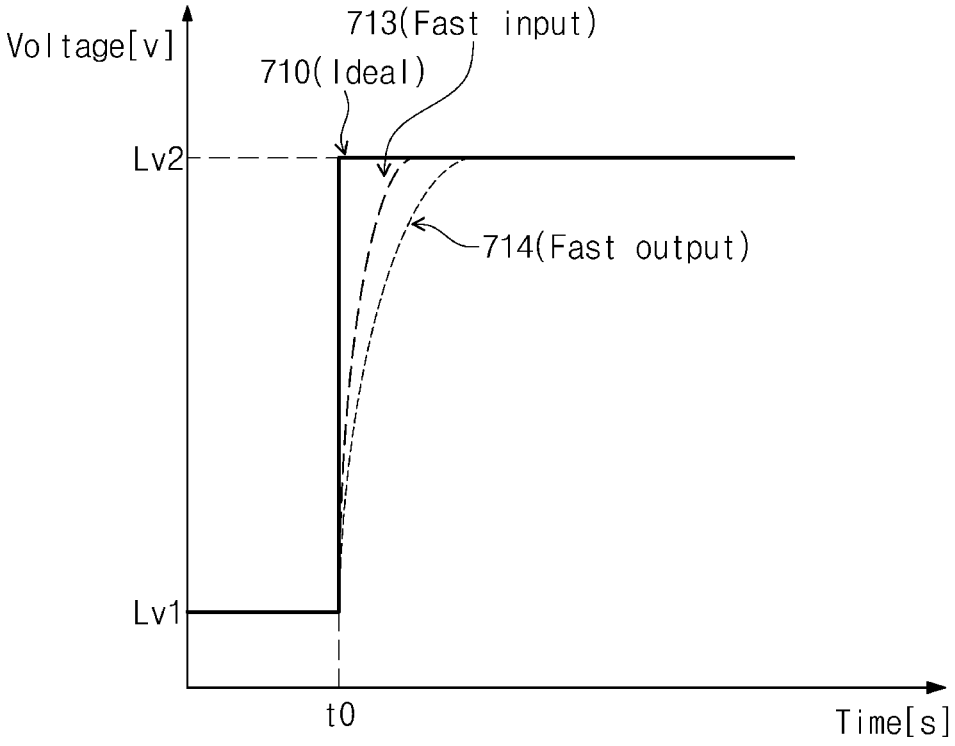
FIG. 5 is a graph describing an operation effect of a source driver, according to embodiments.

FIG. 5 is a graph describing an operation effect of a source driver, according to embodiments.

As described with reference to FIG. 4, before the time t0, the selector 331 of FIG. 3 may output the first gamma voltage v1. At the time t0, the selector 331 may receive the second bit set bs2 of FIG. 3. Accordingly, the selector 331 may start the operation for outputting the second gamma voltage v2 at the time t0.

As described with reference to FIG. 4, the graph 710 represents the voltage level of the node n1 of FIG. 3 in the ideal case.

When the voltage regulator 520 of FIG. 3 operates, the voltage level of the node n0 of FIG. 3 may be adjusted more quickly to the second voltage level. A graph 713 represents the voltage level of the node n0 when the voltage level of the node n0 is adjusted quickly to the second voltage level. A graph 714 represents the voltage level of the node n1 of FIG. 3. Because the voltage level of the node n0 is adjusted quickly to the second voltage level, the voltage level of the node n1 may also be adjusted quickly to the second voltage level.

As described with reference to FIGS. 2 and 3, the source driver 300*a* may adjust more quickly a level of the voltage (voltage level of the node n0) that is input to the output amplifier 332 to the second voltage level, by using the voltage regulator 520. That is, referring to FIGS. 4 and 5, the source driver 300*a* may quickly adjust the level (voltage level of the node n1) of the voltage output from the output amplifier 332, by quickly adjusting the level of the voltage (voltage level of the node n0) that is input to the output amplifier 332.

However, the operation effect of the source driver 300*a* is not limited to the operation effect that is described with reference to FIG. 4. When the source driver 300*a* outputs the second gamma voltage v2 and then outputs the first gamma voltage v1, the source driver 300*a* also may quickly adjust the voltage level of the node n0 to the first voltage level. That is, the source driver 300*a* may quickly adjust the voltage level of the node n0 to the target level.

Figure 6:
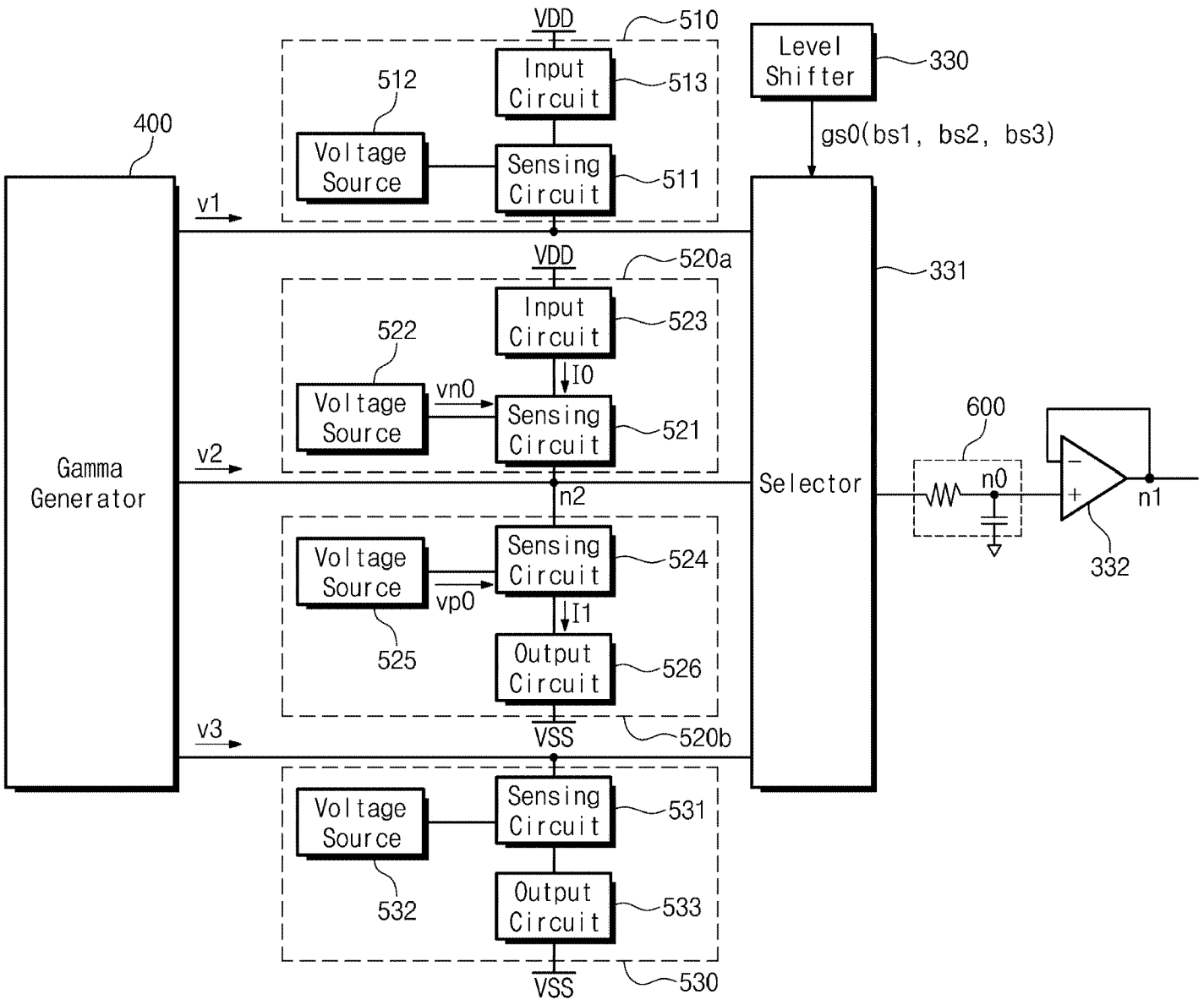
FIG. 6 is a block diagram illustrating a voltage regulator according to embodiments.

FIG. 6 is a block diagram illustrating a voltage regulator according to embodiments.

The voltage regulator 510 may include a sensing circuit 511, a voltage source 512, and an input circuit 513. The voltage regulator 520 of FIG. 6 may include sensing circuits 521 and 524, voltage sources 522 and 525, an input circuit 523, and an output circuit 526. In the following descriptions, a configuration including the sensing circuit 521, the voltage source 522, and the input circuit 523 is represented as a voltage regulator 520*a*. A configuration including the sensing circuit 524, the voltage source 525, and the output circuit 526 is represented as a voltage regulator 520*b*. The voltage regulator 530 may include a sensing circuit 531, a voltage source 532, and an output circuit 533.

However, the embodiments are not limited thereto, and the voltage regulator 510 may not include the voltage source 512 and the input circuit 513. The voltage regulator 520 may not include the voltage sources 522 and 525, the input circuit 523, and the output circuit 526. The voltage regulator 530 may not include the voltage source 532 and the output circuit 533.

Hereinafter, for a better understanding of the embodiments, operations of the sensing circuits 521 and 524, the voltage sources 522 and 525, the input circuit 523, and the output circuit 526 will be described in detail. The sensing circuit 511 and the input circuit 513 may provide similar operations as the sensing circuit 521 and the input circuit 523. The sensing circuit 531 and the output circuit 533 may provide similar operations as the sensing circuit 524 and the output circuit 526.

When the first bit set bs1 and the second bit set bs2 are sequentially received, the selector 331 may sequentially output the first gamma voltage v1 and the second gamma voltage v2. The voltage regulator 520*a* may quickly adjust the voltage level of the node n0 from the first voltage level to the second voltage level. That is, the voltage regulator 520*a* may be used to quickly increase the voltage level of the node n0.

The input circuit 523 may output a current I0 from a power supply node to the sensing circuit 521. The voltage of the power supply node may be a power supply voltage VDD. The level of the power supply voltage VDD may be higher than the third voltage level. The sensing circuit 521 may receive the current I0. The voltage source 522 may output a reference voltage vn0 to the sensing circuit 521. The sensing circuit 521 may compare a voltage of the node n2 with a voltage of the reference voltage vn0. The sensing circuit 521 may compare the voltage level of the node n2 with the first reference level of the reference voltage vn0. The sensing circuit 521 may output the current I0 to the node n2 when the voltage level of the node n2 is lower than the first reference level. The sensing circuit 521 may not output the current I0 to the node n2 when the voltage level of the node n2 is higher than or equal to the first reference level.

The first reference level may be determined based on the second voltage level. In detail, the first reference level may be a level between a level higher by a threshold level than the second voltage level and a level lower by the threshold level than the second voltage level. As an example, the threshold level may be 1 volt.

The sensing circuit 521 outputs the current I0 to the node n2, thereby rapidly increasing the voltage level of the node n2 to the first reference level. After the voltage level of the node n2 is increased to the first reference level by the voltage regulator 520*a*, the voltage level of the node n2 may be increased up to the second voltage level, by the gamma generator 400. The first reference level may be a level higher than the second voltage level by the threshold level. In this case, the voltage regulator 520*a* may increase the voltage level of the node n2 to the second voltage level more quickly.

That is, the voltage regulator 520*a* outputs the current I0 to the node n2, thereby rapidly increasing the voltage level of the node n2 to the second voltage level. The rapidly increasing the voltage level of the node n2 to the second voltage level means increasing the voltage level of the node n0 to the second voltage level quickly. Similar to the voltage regulator 520*a*, the voltage regulator 510 may quickly adjust the voltage level of the node n0 to the first voltage level.

As described with reference to FIG. 2, when the selector 331 starts an operation for outputting the second gamma voltage v2, the capacitor of the parasitic circuit 600 may be charged with charges corresponding to the first voltage level of the first gamma voltage. The sensing circuit 521 may shorten the delay caused by the capacitor of the parasitic circuit 600.

When the third bit set bs3 and the second bit set bs2 are sequentially received, the selector 331 may sequentially output the third gamma voltage v3 and the second gamma voltage v2. The voltage regulator 520*b* may quickly adjust the voltage level of the node n0 from the third voltage level to the second voltage level. That is, the voltage regulator 520*b* may be used to quickly decrease the voltage level of the node n0.

The voltage source 525 may output a reference voltage vp0 to the sensing circuit 524. The sensing circuit 524 may compare the voltage of the node n2 with the reference voltage vp0. The sensing circuit 524 may compare the second reference level of the reference voltage vp0 with the voltage level of the node n2. The sensing circuit 524 may output a current I1 from the node n2 to the output circuit 526 when the voltage level of the node n2 is higher than the second reference level. The output circuit 526 may output the current I1 to ground. The voltage of ground may be a ground voltage VSS. The level of the ground voltage VSS may be lower than the first voltage level. The sensing circuit 521 may not output the current I1 to the output circuit 526 when the voltage level of the node n2 is lower than or equal to the second reference level.

The second reference level may be determined based on the second voltage level. In detail, the second reference level may be a level between a level higher than the second voltage level by a threshold level and a level lower than the second voltage level by the threshold level. As an example, the threshold level may be 1 volt.

The sensing circuit 524 outputs the current I1 from the node n2, thereby rapidly decreasing the voltage level of the node n2 to the second reference level. After the voltage level of the node n2 is reduced to the second reference level by the voltage regulator 520*b*, the voltage level of the node n2 may be reduced to the second voltage level by the gamma generator 400. The second reference level may be a level lower by the threshold level than the second voltage level. In this case, the voltage regulator 520*b* may decrease the voltage level of the node n2 to the second voltage level more quickly.

That is, the voltage regulator 520*b* outputs the current I1 from the node n2, thereby rapidly decreasing the voltage level of the node n2 to the second voltage level. Lowering the voltage level of the node n2 to the second voltage level quickly means lowering the voltage level of the node n0 to the second voltage level quickly. Similar to the voltage regulator 520*b*, the voltage regulator 530 may quickly adjust the voltage level of the node n0 to the third voltage level.

When the selector 331 starts an operation for outputting the second gamma voltage v2, the capacitor of the parasitic circuit 600 may be charged with charges corresponding to the third voltage level of the third gamma voltage. The sensing circuit 521 may shorten the delay caused by the capacitor of the parasitic circuit 600.

The voltage regulator 510 may further include a component that provides similar operations as the voltage regulator 520*b*, unlike that illustrated in FIG. 6. However, when the first voltage level is the lowest among the levels of gamma voltages generated by the gamma generator 400, the voltage regulator 510 may not include additional components.

The voltage regulator 530 may further include a component that provides similar operations as the voltage regulator 520*a*, unlike that illustrated in FIG. 6. However, when the third voltage level is the highest among the levels of gamma voltages generated by the gamma generator 400, the voltage regulator 530 may not include additional components.

In addition, the voltage regulator 500 may quickly adjust the voltage level of the node n0 to the target level only by including one or more voltage regulators among the voltage regulators 510, 520*a*, 520*b*, and 530.

Figure 7:
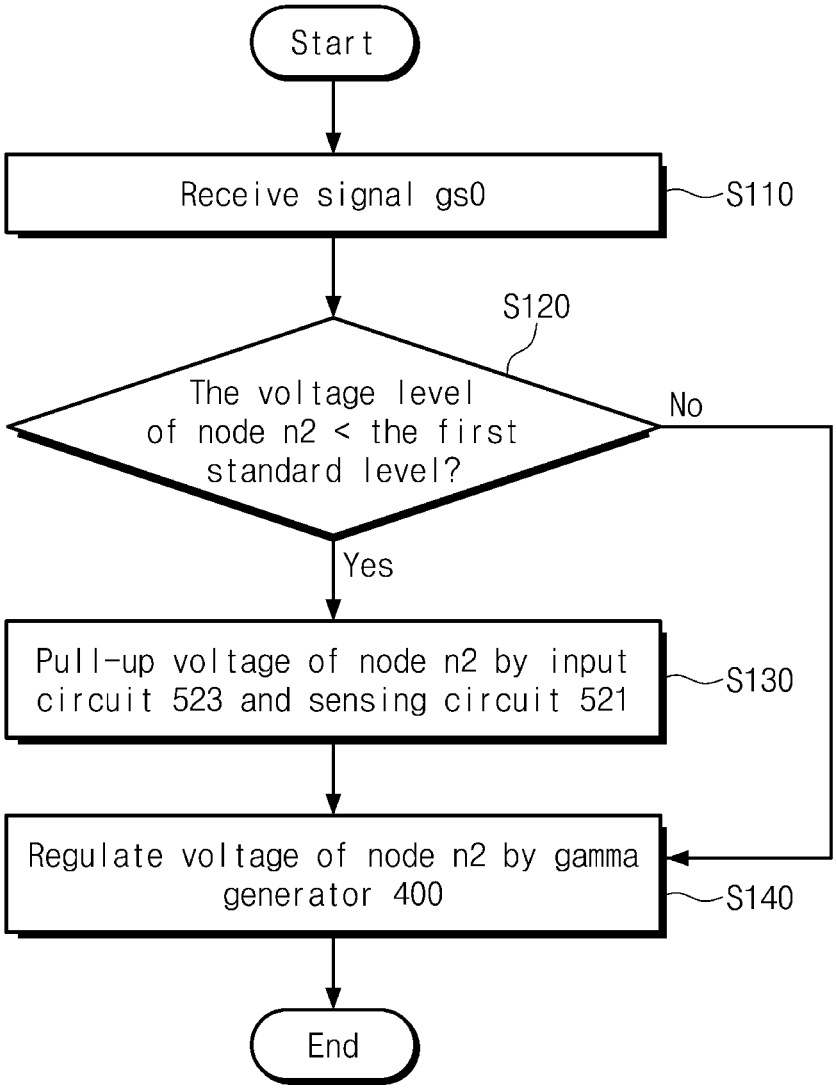
FIG. 7 is a flowchart describing an operation of a voltage regulator, according to embodiments.

FIG. 7 is a flowchart describing an operation of a voltage regulator, according to embodiments. Referring to FIG. 7, the operation of the voltage regulator 520*a* of FIG. 6 will be described.

As described with reference to FIG. 6, the voltage regulator 520*a* may be used when the voltage level of the node n0 of FIG. 6 is adjusted from a level higher than the second voltage level to the second voltage level. Therefore, in the description referring to FIG. 7, it is assumed that the voltage level of the node n0 is adjusted to a level higher than the second voltage level.

In operation S110, the selector 331 of FIG. 6 may receive the gray level signal gs0. In detail, the selector 331 of FIG. 6 may receive the second bit set bs2 included in the gray level signal gs0. The selector 331 may start an operation for outputting the second gamma voltage v2 to the node n0 when the second bit set bs2 is received.

In operation S120, the sensing circuit 521 of FIG. 6 may compare the voltage of the node n2 with the reference voltage vn0 to determine whether to output the current I0 to the node n2.

When the voltage level of the node n2 is lower than the first reference level, a procedure moves to operation S130. In operation S130, the sensing circuit 521 may output the current I0 to the node n2. The current I0 may be output from the power supply node. The current I0 output from the power supply node may be received to the sensing circuit 521 through the input circuit 513 of FIG. 6. In this case, the voltage level of the node n2 may be rapidly increased to the first reference level by the current I0. Of course, the second gamma voltage v2 may also be used to increase the voltage level of the node n2 to the first reference level.

When the voltage level of the node n2 is higher than the first reference level, the procedure moves to operation S140. In operation S140, the sensing circuit 521 may not output the current I0 to the node n2. In this case, the voltage level of the node n2 may be a level between the first reference level and the second voltage level. The second gamma voltage v2 may be output to the node n2. Due to the second gamma voltage v2, the voltage level of the node n2 may be increased to the second voltage level.

Figure 8:
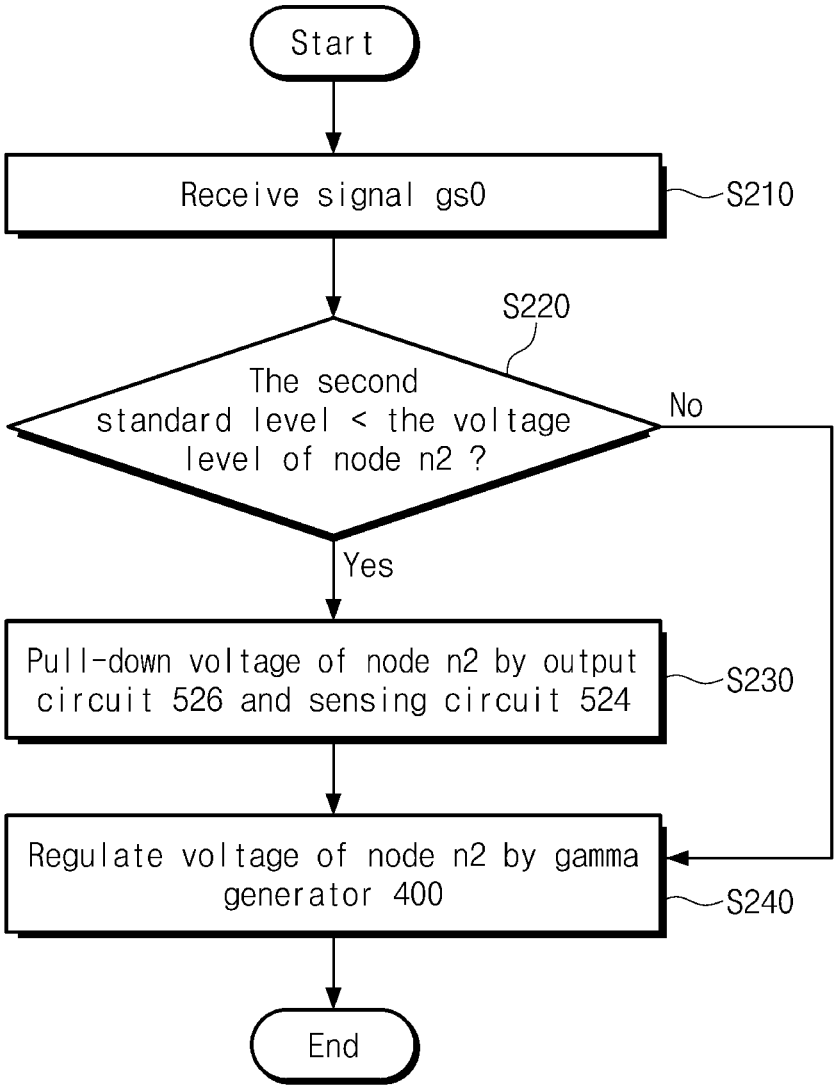
FIG. 8 is a flowchart describing an operation of a voltage regulator, according to embodiments.

FIG. 8 is a flowchart describing an operation of a voltage regulator, according to embodiments. Referring to FIG. 8, an operation of the voltage regulator 520*b* of FIG. 6 will be described.

As described with reference to FIG. 6, the voltage regulator 520*b* may be used when the voltage level of the node n0 of FIG. 6 is adjusted from a level lower than the second voltage level to the second voltage level. Therefore, in the description referring to FIG. 8, it is assumed that the voltage level of the node n0 is adjusted to a level lower than the second voltage level.

In operation S210, the selector 331 of FIG. 6 may receive the gray level signal gs0. In detail, the selector 331 of FIG.

6 may receive the second bit set bs2 included in the gray level signal gs0. The selector 331 may start an operation for outputting the second gamma voltage v2 to the node n0 when the second bit set bs2 is received.

In operation S220, the sensing circuit 524 of FIG. 6 may compare the voltage of the node n2 with the reference voltage vp0 to determine whether to output the current I1 to ground.

When the voltage level of the node n2 is higher than the second reference level, the procedure moves to operation S230. In operation S230, the sensing circuit 524 may output the current I1 from the node n2. The current I1 output from the node n2 may be received to ground through the output circuit 526 of FIG. 6. In this case, the voltage level of the node n2 may be rapidly decreased to the second reference level by the current I1. Of course, the second gamma voltage v2 may also be used to decrease the voltage level of the node n2 to the second reference level.

When the voltage level of the node n2 is lower than the second reference level, the procedure moves to operation S240. In operation S240, the sensing circuit 524 may not output the current I1 from the node n2. In this case, the voltage level of the node n2 may be a level between the second reference level and the second voltage level. The second gamma voltage v2 may be output to the node n2. Due to the second gamma voltage v2, the voltage level of the node n2 may be reduced to the second voltage level.

Figure 9:
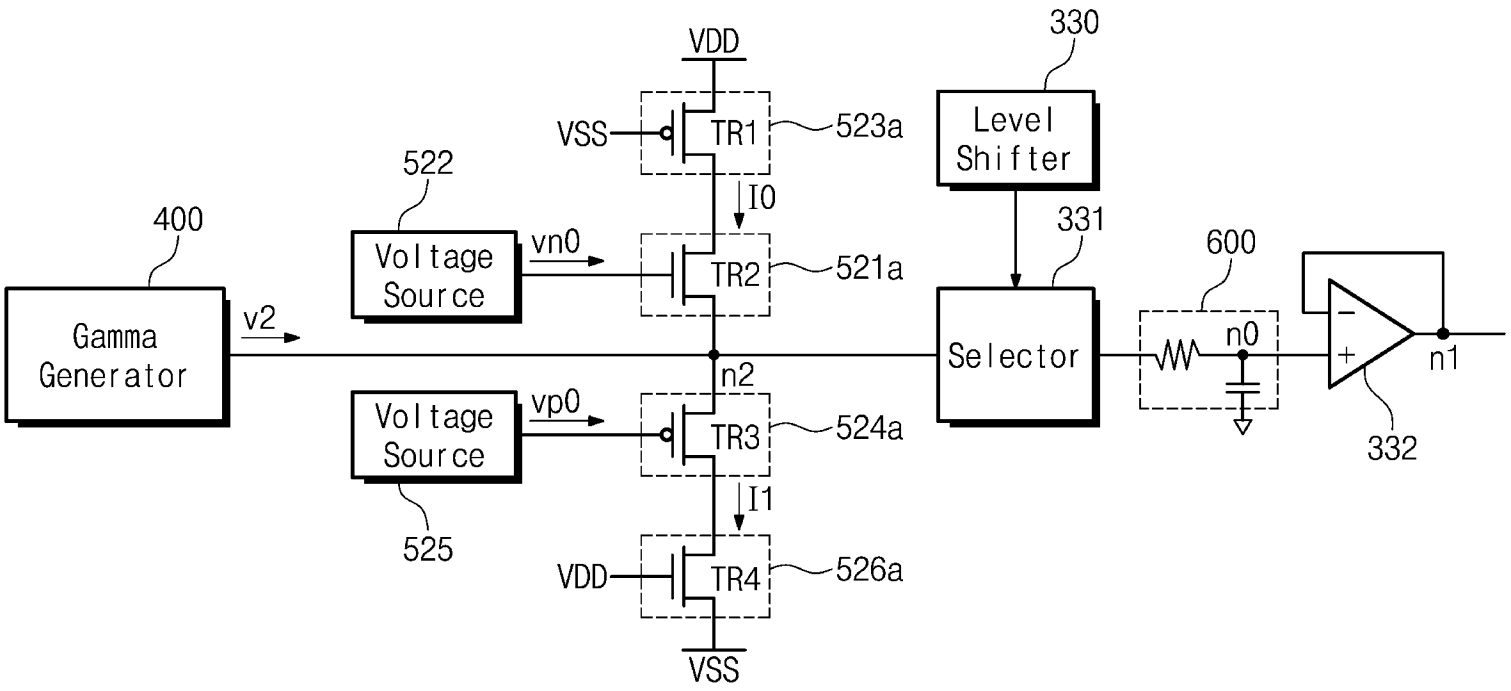
FIG. 9 is a block diagram illustrating a detailed configuration of a voltage regulator according to embodiments.

FIG. 9 is a block diagram illustrating a detailed configuration of a voltage regulator according to embodiments. Components 521*a*, 523*a*, 524*a*, and 526*a* may provide substantially the same operations as the components 521, 523, 524, and 526 of FIG. 6.

The input circuit 523*a* may include a transistor TR1. However, the embodiments are not limited thereto, and the input circuit 523*a* may include a resistor instead of the transistor TR1. In detail, the transistor TR1 may be a PMOS transistor. The ground voltage VSS may be input to the gate terminal of the transistor TR1. The source terminal of the transistor TR1 may be connected to the power supply node, and the drain terminal of the transistor TR1 may be connected to the sensing circuit 521*a*. Because the level of the power supply voltage VDD is higher than the level of the ground voltage VSS, the current I0 may be output from the power supply node to the sensing circuit 521*a* through the transistor TR1.

The sensing circuit 521*a* may include a transistor TR2. In detail, the transistor TR2 may be an NMOS transistor. The gate terminal of the transistor TR2 may be connected to the voltage source 522. The reference voltage vn0 may be input to the gate terminal of the transistor TR2. The drain terminal of the transistor TR2 may be connected to the input circuit 523*a* and the source terminal of the transistor TR2 may be connected to the node n2. When the voltage level of the node n2 is lower than the first reference level of the reference voltage vn0, the current I0 may be output to the node n2 through the transistor TR2. To be precise, the voltage level of the node n2 may be lower than a voltage level that is obtained by subtracting the threshold voltage from the reference voltage vn0. However, for convenience of description, when the voltage level of the node n2 is lower than the first reference level, it is expressed that the current I0 is output to the node n2. However, due to an actual condition that the current I0 is output when the voltage level of the node n2 is lower than the voltage level that is obtained by subtracting the threshold voltage from the reference voltage vn0, the first reference level may be set to a level higher than the second voltage level. When the voltage level of the node n2 is lower than the second voltage level, the voltage level of the node n2 may be rapidly increased to the second voltage level by the current I0 and the second gamma voltage v2.

The sensing circuit 524*a* may include a transistor TR3. In detail, the transistor TR3 may be a PMOS transistor. The gate terminal of the transistor TR3 may be connected to the voltage source 525. The reference voltage vp0 may be input to the gate terminal of the transistor TR3. The drain terminal of the transistor TR3 may be connected to the output circuit 526*a*, and the source terminal of the transistor TR3 may be connected to the node n2. When the voltage level of the node n2 is higher than the second reference level of the reference voltage vp0, the current I1 may be output from the node n2 to the output circuit 526*a* through the transistor TR3. To be precise, the voltage level of the node n2 may be higher than a voltage level that is obtained by adding the threshold voltage with the reference voltage vp0. However, for convenience of description, when the voltage level of the node n2 is higher than the second reference level, it is expressed that the current I1 is output. However, due to the actual condition that the current I1 is output when the voltage level of the node n2 is higher than the voltage level that is obtained by adding the threshold voltage with the reference voltage vp0, the second reference level may be set to a level lower than the second voltage level.

The output circuit 526*a* may include a transistor TR4. However, the embodiments are not limited thereto, and the output circuit 526*a* may include a resistor instead of the transistor TR4. In detail, the transistor TR4 may be an NMOS transistor. The power supply voltage VDD may be input to the gate terminal of the transistor TR4. The source terminal of the transistor TR4 may be connected to ground, and the drain terminal of the transistor TR4 may be connected to the sensing circuit 524*a*. Because the level of the power supply voltage VDD is higher than the level of the ground voltage VSS, the current I1 may be output to ground through the transistor TR4.

When the voltage level of the node n2 is higher than the second voltage level, by the current I1, the voltage level of the node n2 may be rapidly decreased to the second voltage level.

Figure 10:
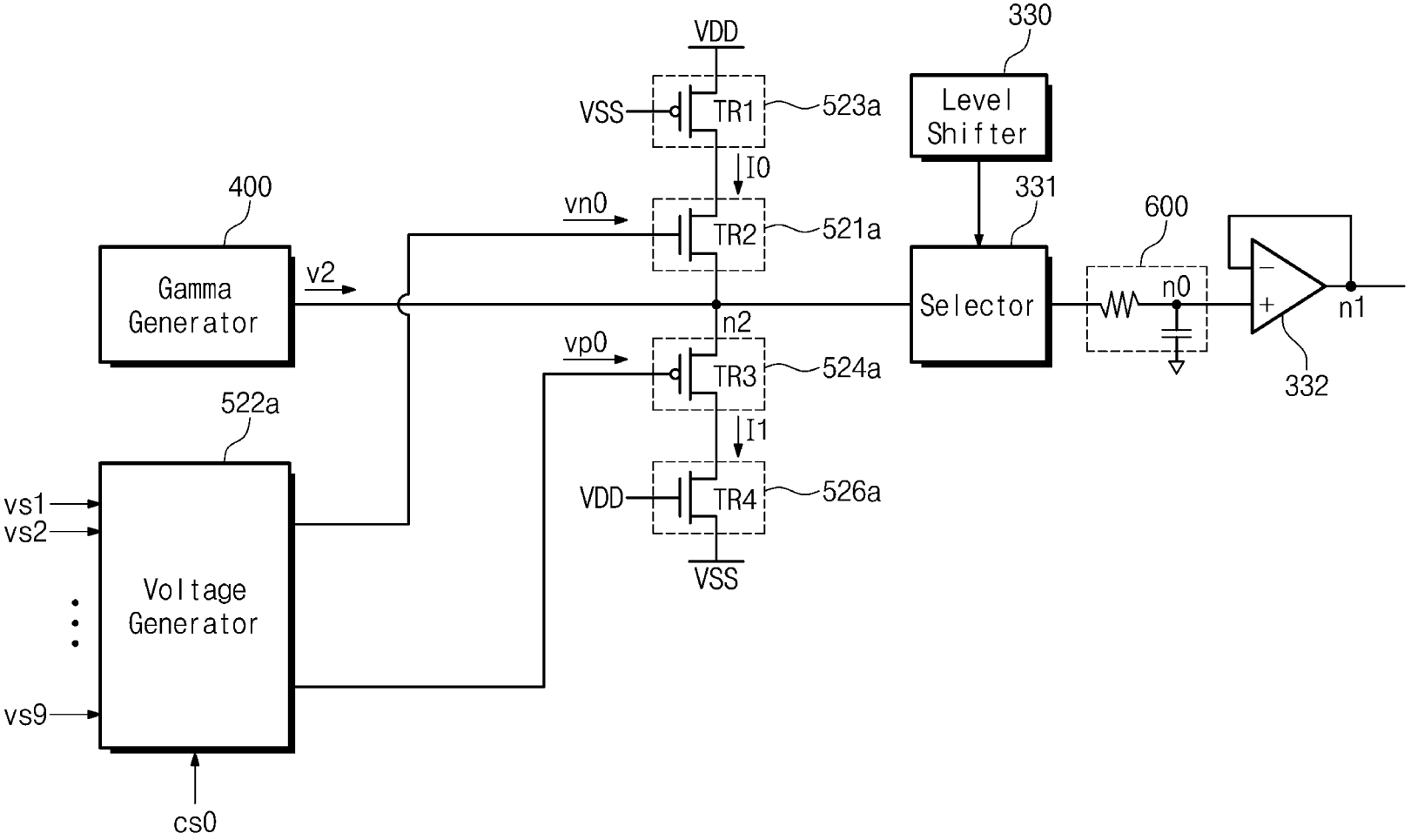
FIG. 10 is a block diagram illustrating a voltage regulator according to embodiments.

FIG. 10 is a block diagram illustrating a voltage regulator according to embodiments. Unlike in FIG. 9, reference voltages vn0 and vp0 are output from a voltage generator 522*a* in FIG. 10. However, except that the reference voltages vn0 and vp0 are output from the voltage generator 522*a*, components illustrated in FIG. 10 provide operations similar to those of the components illustrated in FIG. 9. Therefore, hereinafter, redundant descriptions are omitted, and the configuration and operations related to the voltage generator 522*a* will be described.

The voltage generator 522*a* may receive supply voltages vs1 to vs9. The supply voltages vs1 to vs9 may be analog voltages or digital voltages. The supply voltages vs1 to vs9 may be supplied by components of the source driver 300*a* of FIG. 2, or may be supplied from an outside of the source driver 300*a*. Although nine supply voltages vs1 to vs9 are illustrated in FIG. 10, the embodiments are not limited thereto. The voltage generator 522*a* may receive a plurality of supply voltages.

The voltage generator 522*a* may receive a control signal cs0. The voltage generator 522*a* may output the reference voltage vn0 or the reference voltage vp0 in response to the control signal cs0. The voltage generator 522*a* may adjust the first reference level of the reference voltage vn0 or the second reference level of the reference voltage vp0, based on information included in the control signal cs0. However, the first reference level may be greater than or equal to the second voltage level, and the second reference level may be less than or equal to the second voltage level.

The sensing circuit 521*a* may determine whether to output the current I0 by comparing the first reference level with the voltage level of the node n2. The first reference level may be adjusted based on the control signal cs0. For example, the first reference level may also vary depending on an operation mode of the source driver 300*a*. In an operation mode for adjusting the voltage level of the node n2 to the second voltage level as quickly as possible, the first reference level may be adjusted to the second voltage level. That is, the sensing circuit 521*a* may operate based on the reference voltage vn0 that has different levels depending on the operation mode of the source driver 300*a*.

In detail, the reference voltage vn0 may be input to the gate terminal of the transistor TR2. The transistor TR2 may output the current I0 when the voltage level of the node n2 is lower than the first reference level of the reference voltage vn0. The transistor TR2 may not output the current I0 when the voltage level of the node n2 is higher than the first reference level of the reference voltage vn0.

In addition, the sensing circuit 524*a* may compare the adjusted second reference level with the voltage level of the node n2 to determine whether to output the current I1. The second reference level may be adjusted based on the control signal cs0. For example, in an operation mode for adjusting the voltage level of the node n2 to the second voltage level as quickly as possible, the first reference level may be adjusted to the second voltage level. That is, the sensing circuit 524*a* may operate based on the reference voltage vp0 that has different levels depending on the operation mode of the source driver 300*a*.

In detail, the reference voltage vp0 may be input to the gate terminal of the transistor TR3. The transistor TR3 may output the current I1 when the voltage level of the node n2 is higher than the second reference level of the reference voltage vp0. The transistor TR3 may not output the current I1 when the voltage level of the node n2 is lower than the second reference level of the reference voltage vp0.

Figure 11:
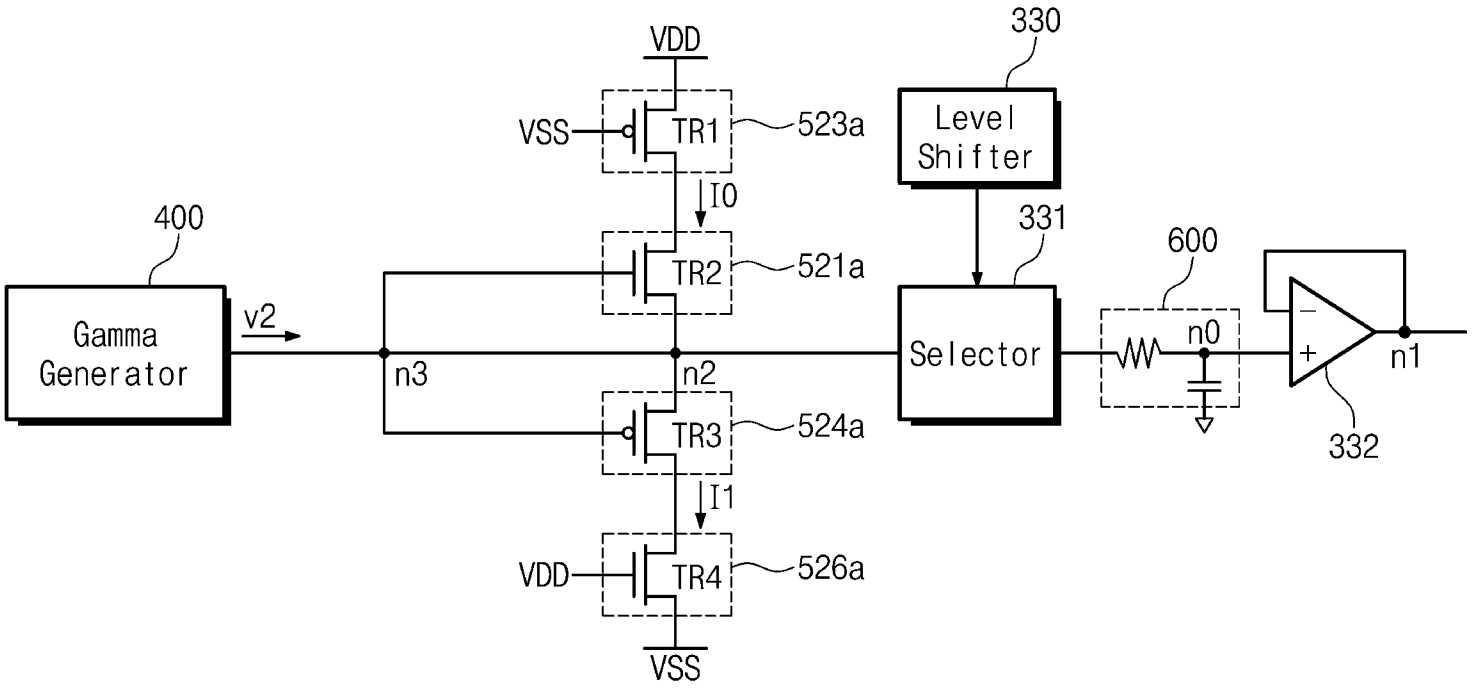
FIG. 11 is a block diagram illustrating a voltage regulator according to embodiments.

FIG. 11 is a block diagram illustrating a voltage regulator according to embodiments. Unlike in FIG. 9, the sensing circuits 521*a* and 524*a* receive the second gamma voltage v2 in FIG. 11. However, except that the sensing circuits 521*a* and 524*a* receive the second gamma voltage v2 instead of the reference voltages vn0 and vp0, components illustrated in FIG. 11 provide similar operations as the components shown in FIG. 9.

The gamma generator 400 may output the second gamma voltage v2 to a node n3. Hereinafter, for convenience of explanation, it is assumed that the voltage level of the node n3 is maintained to the second voltage level. It is also assumed that the second gamma voltage v2 is output from the node n3.

The sensing circuit 521*a* may be connected to the node n3. The sensing circuit 521*a* may receive the second gamma voltage v2 from the node n3. The sensing circuit 521*a* may compare the second voltage level with the voltage level of the node n2 to determine whether to output the current I0. In detail, the gate terminal of the transistor TR2 may be connected to the node n3. The transistor TR2 may output the current I0 when the voltage level of the node n2 is lower than the second voltage level. The transistor TR2 may not output the current I0 when the voltage level of the node n2 is higher than the second voltage level.

The sensing circuit 524*a* may be connected to the node n3. The sensing circuit 524*a* may receive the second gamma voltage v2 from the node n3. The sensing circuit 524*a* may compare the second voltage level with the voltage level of the node n2 to determine whether to output the current I1. In detail, the gate terminal of the transistor TR3 may be connected to the node n3. The transistor TR3 may output the current I1 when the voltage level of the node n2 is higher than the second voltage level. The transistor TR3 may not output the current I1 when the voltage level of the node n2 is lower than the second voltage level.

That is, the embodiments described with reference to FIG. 11 may not include separate voltage sources for supplying the reference voltages vn0 and vp0. According to the embodiments described with reference to FIG. 11, because the reference voltages vn0 and vp0 are supplied using the gamma generator 400, an area, a cost, and etc. by voltage sources may be reduced.

Figure 12:
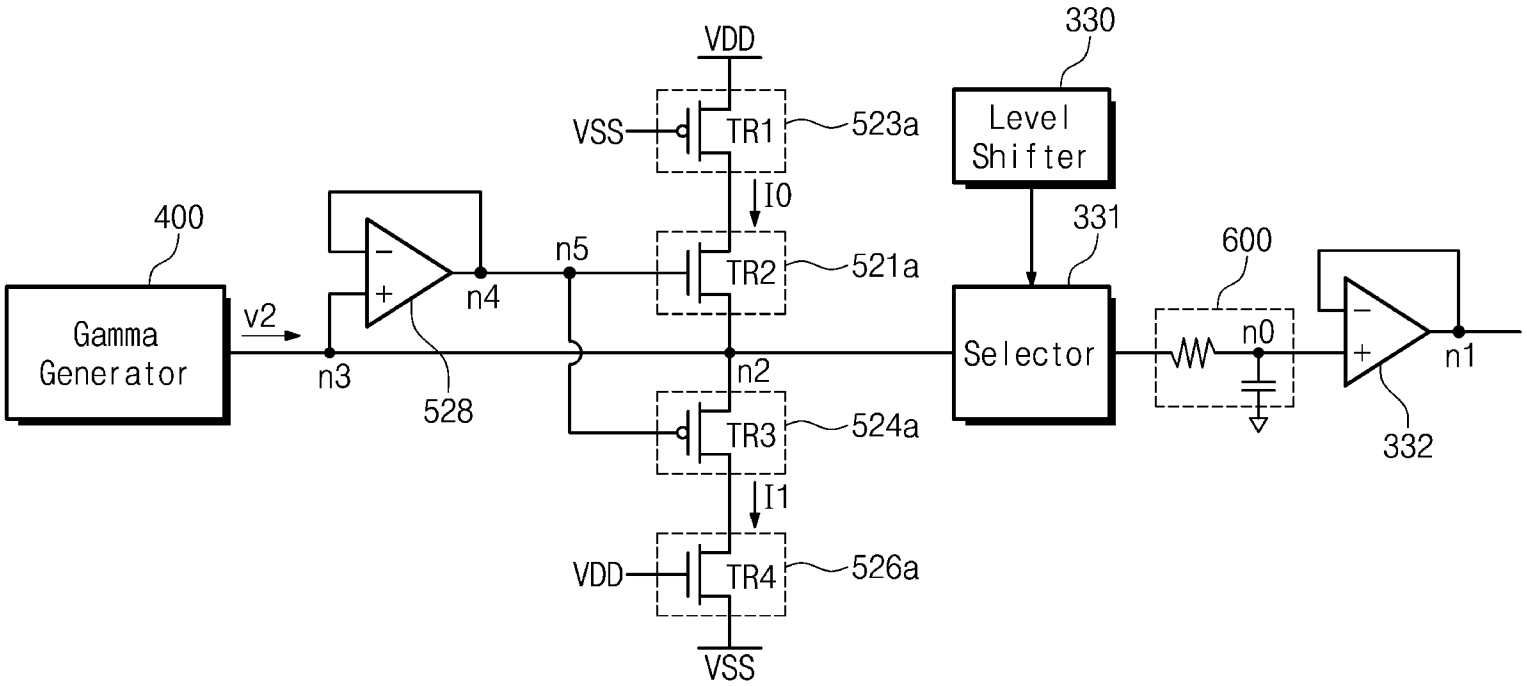
FIG. 12 is a block diagram illustrating a voltage regulator according to embodiments.

FIG. 12 is a block diagram illustrating a voltage regulator according to embodiments. Unlike that illustrated in FIG. 11, a buffer 528 is further illustrated in FIG. 12. However, except that the second gamma voltage v2 is received to the sensing circuits 521*a* and 524*a* through the buffer 528, components shown in FIG. 11 may provide similar operations as those illustrated in FIG. 10.

The gamma generator 400 may output the second gamma voltage v2 to the node n3.

A positive input terminal of the buffer 528 may be connected to node n3. That is, the second gamma voltage v2 may be received to the positive input terminal of the buffer 528. A negative input terminal of the buffer 528 may be connected to a node n4. The node n4 may be connected to the output terminal of the buffer 528. That is, the negative input terminal of the buffer 528 may be connected to the output terminal of the buffer 528.

Accordingly, the buffer 528 may output the second gamma voltage v2 to the node n4 through a feedback operation. The node n4 may be connected to a node n5. It is assumed that no voltage drop occurs between the node n4 and the node n5. Therefore, the voltage level of the node n5 may be the same as the voltage level of the node n4. That is, the second gamma voltage v2 may be output from the node n5 to the sensing circuits 521*a* and 524*a*.

The sensing circuit 521*a* may be connected to the node n5. The sensing circuit 521*a* may receive the second gamma voltage v2 from the node n5. The sensing circuit 521*a* may compare the second voltage level with the voltage level of the node n2 to determine whether to output the current I0. In detail, the gate terminal of the transistor TR2 may be connected to the node n5. The transistor TR2 may output the current I0 when the voltage level of the node n2 is lower than the second voltage level. The transistor TR2 may not output the current I0 when the voltage level of the node n2 is higher than the second voltage level.

The sensing circuit 524*a* may be connected to the node n5. The sensing circuit 524*a* may receive the second gamma voltage v2 from the node n5. The sensing circuit 524*a* may compare the second voltage level with the voltage level of the node n2 to determine whether to output the current I1. In detail, the gate terminal of the transistor TR3 may be connected to the node n5. The transistor TR3 may output the current I1 when the voltage level of the node n2 is higher than the second voltage level. The transistor TR3 may not output the current I1 when the voltage level of the node n2 is lower than the second voltage level.

The embodiments described with reference to FIG. 12 may further include the buffer 528. Therefore, the second gamma voltage v2 may be supplied to the sensing circuits 521*a* and 524*a* more stably.

Figure 13:
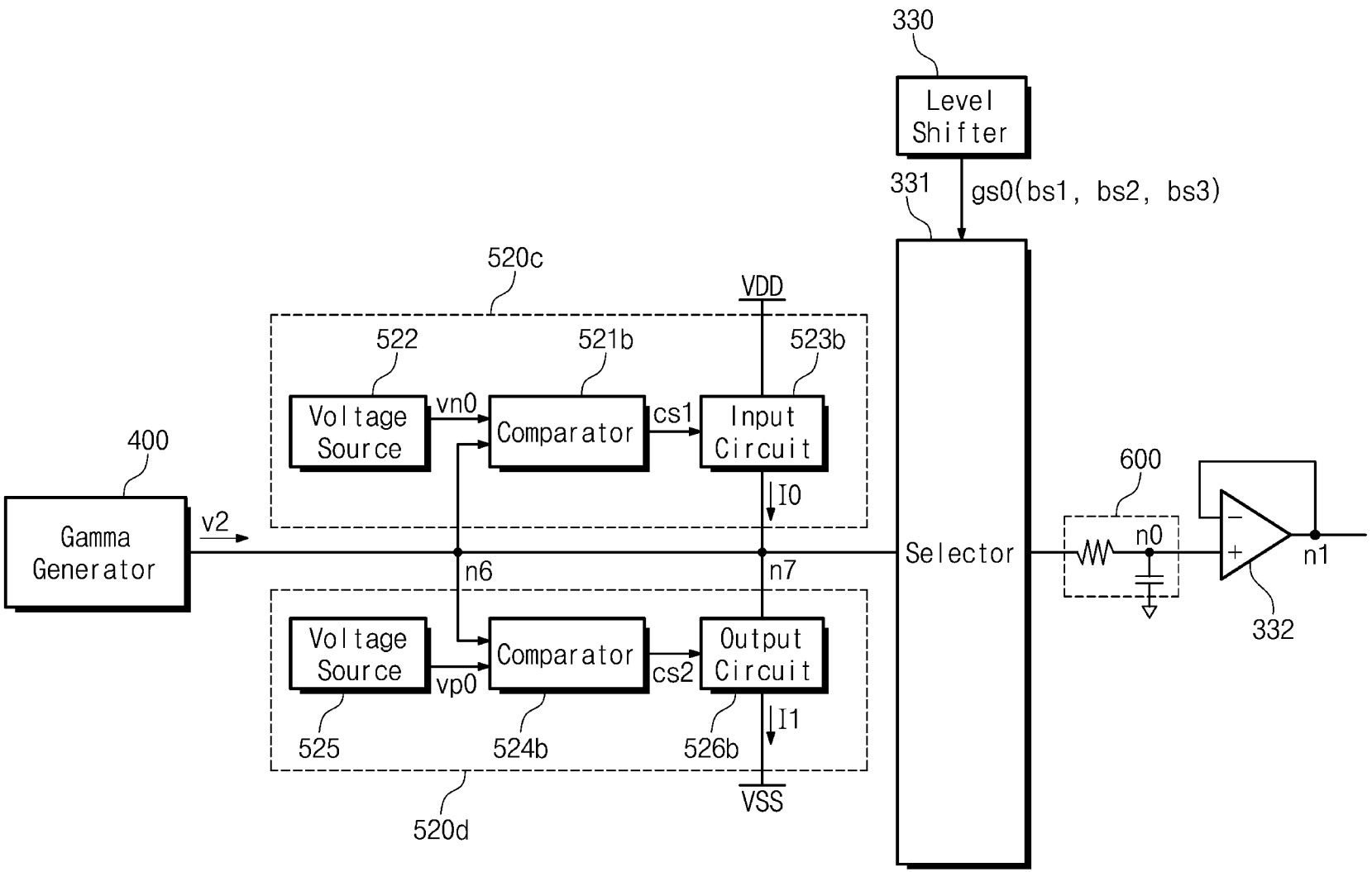
FIG. 13 is a block diagram illustrating a voltage regulator according to embodiments.

FIG. 13 is a block diagram illustrating a voltage regulator according to embodiments.

Referring to FIG. 13, unlike the description with reference to FIG. 6, voltage regulators 520*c* and 520*d* including comparators 521*b* and 524*b* will be described. However, the voltage regulators 520*c* and 520*d* provide operations similar to those of the voltage regulators 520*a* and 520*b* of FIG. 6 except for the operations associated with the comparators 521*b* and 524*b*. Duplicate descriptions will be omitted below, and operations related to the comparators 521*b* and 524*b* will be intensively described.

The voltage regulator 520*c* may include a comparator 521*b*, a voltage source 522, and an input circuit 523*b*.

The comparator 521*b* may receive the reference voltage vn0 from the voltage source 522. The comparator 521*b* may compare the voltage level of the node n6 with the reference voltage vn0. In the following descriptions, it is assumed that the voltage level of the node n6 is the same as the voltage level of the node n7. As described with reference to FIG. 3, the voltage level of the node n6 and the voltage level of the node n7 may be affected by the parasitic circuit 600, and thus may not maintain the second voltage level of the second gamma voltage v2.

The comparator 521*b* may output a control signal cs1 when the first reference level is higher than the voltage level of the node n6. The input circuit 523*b* may output the current I0 to the node n7 when the control signal cs1 is received. As an example, the input circuit 523*b* may include a current source. As another example, the input circuit 523*b* may include a device such as a resistor or a transistor, and in this case, may output the current I0 to the node n7, based on the power supply voltage VDD.

The comparator 521*b* may not output the control signal cs1 when the first reference level is less than or equal to the voltage level of the node n6. The input circuit 523*b* may not output the current I0 to the node n7 when the control signal cs1 is not received.

However, the embodiments are not limited thereto, and the comparator 521*b* may output the control signal cs1 having a first logic value when the first reference level is higher than the voltage level of the node n6. In this case, the input circuit 523*b* may output the current I0 to the node n7 in response to the control signal cs1 having the first logic value. The comparator 521*b* may output the control signal cs1 having a second logic value when the first reference level is less than or equal to the voltage level of the node n6. In this case, the input circuit 523*b* may not output the current I0 to the node n7 in response to the control signal cs1 having the second logic value.

However, the embodiments are not limited thereto, and the voltage regulators 520*c* and 520*d* may not include the voltage sources 522 and 525. In this case, the voltage regulators 520*c* and 520*d* may receive the reference voltages vn0 and vp0 similarly to those described with reference to FIGS. 10 to 12. In detail, the voltage regulators 520*c* and 520*d* may receive the reference voltages vn0 and vp0 from the voltage generator 522*a* of FIG. 10, similarly to those described with reference to FIG. 10. The voltage regulators 520*c* and 520*d* may receive the second gamma voltage v2 instead of the reference voltages vn0 and vp0, similar to those described with reference to FIG. 11. In this case, the voltage regulators 520*c* and 520*d* may determine whether to output the currents I0 and I1 by comparing the second voltage level of the second gamma voltage v2 with the voltage level of the node n6. The voltage regulators 520*c* and 520*d* may include the buffer 528 of FIG. 12, similar to that described with reference to FIG. 12. In this case, the voltage regulators 520*c* and 520*d* receive the second gamma voltage v2 instead of the reference voltages vn0 and vp0, and more stably receive the second gamma voltage v2, using the buffer 528.

Figure 14:
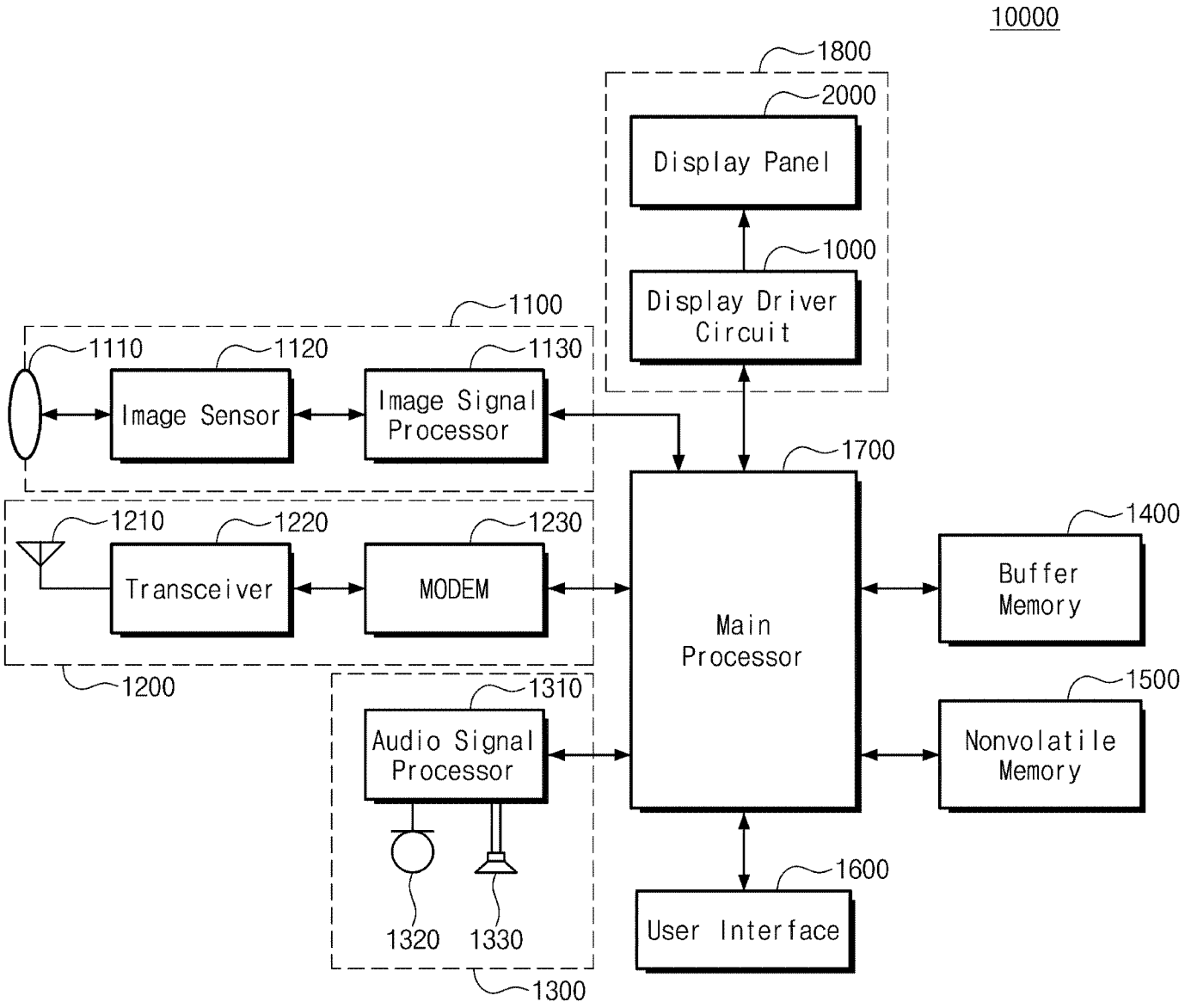
FIG. 14 is a block diagram illustrating a configuration of an electronic device including a display driver circuit according to embodiments.

FIG. 14 is a block diagram illustrating a configuration of an electronic device including a display driver circuit according to embodiments. For example, an electronic device 10000 may be implemented as one of various types of electronic devices such as a smartphone, a tablet personal computer, a laptop personal computer, an e-book reader, an MP3 player, a wearable device, and etc.

The electronic device 10000 may include various electronic circuits. For example, the electronic circuits of the electronic device 10000 may include a display device 1800, an image processing block 1100, a communication block 1200, an audio processing block 1300, a buffer memory 1400, and a nonvolatile memory 1500, a user interface 1600, and a main processor 1700.

The display device 1800 may receive data from an external device (e.g., the main processor 1700). A display driver circuit 1000 included in the display device 1800 may display the image on a display panel 2000, based on the received data.

The display driver circuit 1000 may output image signals to the display panel 2000 such that the image is displayed on the display panel 2000. Outputting the image signals to the display panel 2000 means outputting voltages corresponding to the image signals to the display panel 2000. The display driver circuit 1000 may quickly output voltages corresponding to the image signals, using the voltage regulator 500.

The image processing block 1100 may receive light through a lens 1110. An image sensor 1120 and an image signal processor 1130 that are included in the image processing block 1100 may generate image data related to an external object, based on the received light.

The communication block 1200 may exchange signals with an external device/system through an antenna 1210. A transceiver 1220 and a MODEM 1230 (modulator/demodulator) of the communication block 1200 may process the signals that are exchanged with the external device/system, based on various wireless communication protocols.

The audio processing block 1300 may process sound information, using an audio signal processor 1310, thereby reproducing and outputting audio. The audio processing block 1300 may receive an audio input through a microphone 1320. The audio processing block 1300 may output the reproduced audio through a speaker 1330.

The buffer memory 1400 may store data that are used for the operation of the electronic device 10000. For example, the buffer memory 1400 may temporarily store data that are processed or to be processed by the main processor 1700. For example, the buffer memory 1400 may include a volatile memory such as a static random access memory (SRAM), a dynamic RAM (DRAM), a synchronous DRAM (SDRAM), and etc. and/or a non-volatile memory such as a phase-change RAM (PRAM), a magneto-resistive RAM (MRAM), a resistive RAM (ReRAM), a ferro-electric RAM (FRAM), and etc.

The nonvolatile memory 1500 may store data regardless of power supply. For example, the nonvolatile memory 1500 may include any one or any combination of various nonvolatile memories such as a flash memory, a PRAM, an MRAM, a ReRAM, a FRAM, and etc. By way of example, the nonvolatile memory 1500 may include a removable memory such as a Secure Digital (SD) card, and/or an embedded memory such as an embedded multimedia card (eMMC).

The user interface 1600 may mediate communication between the user and the electronic device 10000. For example, the user interface 1600 may include an input interface such as a keypad, a button, a touch screen, a touch pad, a gyroscope sensor, a vibration sensor, an acceleration sensor, and etc. By way of example, the user interface 1600 may include an output interface such as a motor, an LED lamp, and etc.

The main processor 1700 may control overall operations of the components of the electronic device 10000. The main processor 1700 may process various operations to operate the electronic device 10000. By way of example, the main processor 1700 may be implemented as an operation processing unit/circuit including one or more processor cores, such as a general-purpose processor, a special-purpose processor, an application processor, a microprocessor, and etc.

For example, the main processor 1700 may transmit data to the display driver circuit 1000. The display driver circuit 1000 may drive the display panel 2000 to display an image on the display panel 2000, based on the data.

As another example, the user may set an operation mode of the display device 1800 through the user interface 1600. The main processor 1700 may control a type of data transmitted to the display driver circuit 1000 or a speed of data transmitted to the display driver circuit 1000, based on an operation mode set by the user. The display driver circuit 1000 may control a path in which data is processed, based on the type of the received data or the speed of the received data.

However, the components illustrated in FIG. 14 are provided to enable a better understanding and are not intended to limit the embodiments. The electronic device 10000 may not include one or more of the components shown in FIG. 14, and may additionally or alternatively include at least one component not illustrated in FIG. 14.

According to embodiments, a source driver may accelerate a voltage output to a data line by quickly adjusting a voltage level input to an output amplifier to a target level. Also, the source driver may uniformly adjust times that output voltages to data lines.

As is traditional in the field of the inventive concepts, the embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

The contents described above are embodiments for implementing the inventive concept. The inventive concept may include not only the embodiments described above but also embodiments in which a design is simply or easily capable of being changed. In addition, the inventive concept may also include technologies easily changed to be implemented using embodiments. Therefore, the scope of the inventive concept is not limited to the described embodiments but may be defined by the claims and their equivalents.

What is claimed is:

1. A display driving circuit comprising:

a gamma generator configured to output, to nodes, gamma voltages having different voltage levels;

a selector configured to:

select one of the nodes to which the gamma voltages are output; and output a voltage of the selected one of the nodes; and a voltage regulator that is electrically connected between an output of the gamma generator and an input of the selector, and is configured to selectively input a first current to the selected one of the nodes and output a second current from the selected one of the nodes, based on the voltage of the selected one of the nodes, to adjust a voltage level of the voltage of the selected one of the nodes to a voltage level of a respective one of the gamma voltages that is output to the selected one of the nodes.

2. The display driving circuit of claim 1, wherein the voltage regulator is further configured to:

based on the voltage level of the voltage of the selected one of the nodes being lower than a first reference level, input and pull up the first current to the selected one of the nodes; and based on the voltage level of the voltage of the selected one of the nodes being higher than a second reference level, output and pull down the second current from the selected one of the nodes.

3. The display driving circuit of claim 2, wherein the first reference level and the second reference level are between a level higher than the voltage level of the respective one of the gamma voltages by a threshold level and a level lower than the voltage level of the respective one of the gamma voltages by the threshold level.

4. The display driving circuit of claim 3, wherein the first reference level is higher than the voltage level of the respective one of the gamma voltages by the threshold level, and wherein the second reference level is lower than the voltage level of the respective one of the gamma voltages by the threshold level.

5. A display driving circuit comprising:

a gamma generator configured to:

output, to a first node, a first gamma voltage having a first voltage level; and output, to a second node, a second gamma voltage having a second voltage level higher than the first voltage level;

a selector configured to output a second node voltage of the second node to which the second gamma voltage is output, after outputting a first node voltage of the first node to which the first gamma voltage is output; and a voltage regulator that is electrically connected between an output of the gamma generator and an input of the selector, and is configured to, based on a voltage level of the second node voltage being lower than a first reference level, input a first current to the second node to which the second gamma voltage is output, wherein the first reference level is between a level higher than the second voltage level by a threshold level and a level lower than the second voltage level by the threshold level.

6. The display driving circuit of claim 5, wherein the voltage regulator is further configured to, based on the voltage level of the second node voltage being lower than the first reference level, input and pull up the first current to the second node to which the second gamma voltage is output, such that the second node voltage has the second voltage level by the second gamma voltage and the first current.

7. The display driving circuit of claim 5, wherein the voltage regulator comprises an NMOS transistor configured to input the first current to the second node to which the second gamma voltage is output, and wherein the first reference level is of a gate voltage of the NMOS transistor.

8. The display driving circuit of claim 7, wherein the voltage regulator further comprises a PMOS transistor configured to input the first current into the NMOS transistor.

9. The display driving circuit of claim 5, wherein the gamma generator is further configured to output, to a third node, a third gamma voltage having a third voltage level higher than the second voltage level, wherein the selector is further configured to output the second node voltage of the second node to which the second gamma voltage is output, after outputting a third node voltage of the third node is output to which the third gamma voltage is output, wherein the voltage regulator is further configured to, based on the voltage level of the second node voltage being higher a second reference level, output a second current from the second node to which the second gamma voltage is output, and wherein the second reference level is between the level higher than the second voltage level by the threshold level and the level lower than the second voltage level by the threshold level.

10. The display driving circuit of claim 9, further comprising a voltage generator configured to:

combine a plurality of voltages; and supply, to the voltage regulator, a first reference voltage having the first reference level and a second reference voltage having the second reference level, based on the combined plurality of voltages.

11. The display driving circuit of claim 10, wherein the voltage generator comprises a multiplexer configured to:

receive the plurality of voltages; and output the first reference voltage and the second reference voltage, based on the received plurality of voltages.

12. The display driving circuit of claim 10, wherein the voltage generator is further configured to adjust the first reference level and the second reference level, based on a control signal.

13. A display driving circuit comprising:

a gamma generator configured to:

output, to a first node, a first voltage having a first voltage level; and output, to a second node, a second voltage having a second voltage level higher than the first voltage level;

a selector configured to output a first node voltage of the first node to which the first voltage is output, after outputting a second node voltage of the second node to which the second voltage is output; and a voltage regulator that is electrically connected between an output of the gamma generator and an input of the selector, and is configured to, based on a voltage level of the first node voltage being higher than a first reference level, output a first current from the first node to which the first voltage is output, wherein the first reference level is between a level higher than the first voltage level by a threshold level and a level lower than the first voltage level by the threshold level.

14. The display driving circuit of claim 13, wherein the voltage regulator is further configured to, based on the voltage level of the first node voltage being higher than the first reference level, output and pull down the first current from the first node to which the first voltage is output, to ground, such that the first node voltage has the first voltage level by the first voltage and the first current.

15. The display driving circuit of claim 13, further comprising a voltage source configured to supply, to the voltage regulator, a first reference voltage having the first reference level, wherein the voltage regulator is further configured to compare the first node voltage with the supplied first reference voltage to determine whether to output the first current from the first node.

16. The display driving circuit of claim 13, wherein the first reference level is the first voltage level, and wherein the voltage regulator is further configured to:

receive the output first voltage from the gamma generator; and compare the first node voltage with the received first voltage to determine whether to output the first current from the first node.

17. The display driving circuit of claim 16, further comprising a buffer configured to:

receive the output first voltage from the gamma generator; and output the received first voltage to the voltage regulator.

18. The display driving circuit of claim 13, wherein the voltage regulator comprises a PMOS transistor configured to output the first current from the first node to which the first voltage is output, and wherein the first reference level is a level of a gate voltage of the PMOS transistor.

19. The display driving circuit of claim 18, wherein the voltage regulator further comprises an NMOS transistor configured to output the first current output from the PMOS transistor, to ground.

20. The display driving circuit of claim 18, wherein the voltage regulator further comprises a comparator configured to compare the voltage level of the first node voltage with the first reference level, to output a control signal; and an output circuit configured to output the first current from the first node to which the first voltage is output, to ground, based on the output control signal.

* * * * *